United States Patent [19]

Otto

[11] 4,113,432

[45] Sep. 12, 1978

[54] METHOD FOR MODIFYING FIBERS OF A FABRIC AND THE PRODUCTS SO PRODUCED

[75] Inventor: Wolfgang K. F. Otto, Spartanburg, S.C.

[73] Assignee: Milliken Research Corporation, Spartanburg, S.C.

[21] Appl. No.: 799,620

[22] Filed: May 23, 1977

[51] Int. Cl.[2] ..... D06M 1/02

[52] U.S. Cl. ..... 8/125; 8/4; 8/14; 8/114.6; 8/115.5; 8/116 R; 8/188

[58] Field of Search ..... 8/115.5, 114.6, 116 R, 8/188, 125, 14, 4

[56] References Cited

U.S. PATENT DOCUMENTS

| | | | |
|---|---|---|---|
| 1,802,956 | 4/1931 | Platt | 8/167 |
| 1,884,620 | 10/1932 | Dreyfus et al. | 8/167 |
| 2,590,402 | 3/1952 | Hall et al. | 8/115.5 |
| 2,781,242 | 2/1957 | Knapp | 8/DIG. 4 |
| 2,989,797 | 6/1961 | Nusslein | 8/114.6 |
| 3,135,577 | 6/1964 | Watson | 8/115.5 |
| 3,644,079 | 2/1972 | Smith et al. | 8/4 |
| 3,644,080 | 2/1972 | McCullough et al. | 8/4 |
| 3,669,611 | 6/1972 | Shinauchi et al. | 8/14 |
| 3,874,958 | 4/1975 | Scholtis et al. | 8/114.6 |
| 4,008,044 | 2/1977 | Latta et al. | 8/115.5 |

*Primary Examiner*—A. Lionel Clingman

*Attorney, Agent, or Firm*—H. William Petry; G. Mike Burdick

[57] ABSTRACT

A method for modifying fibers of a fabric which comprises applying an effective amount of a heat activated fiber modifying agent to a fabric, applying an effective amount of a deactivating agent to one surface of the fabric, such surface being opposite a surface containing fibers wet with the heat activated fiber modifying agent, heating the surface of the fabric containing the heat activated fiber modifying agent for a period of time effective to initiate a chemical reaction between the fibers wet with the heat activated fiber modifying agent and such agent while maintaining a temperature differential between the heated surface of the fabric containing the fibers wet with the heat activated fiber modifying agent and the opposite surface of the fabric containing the deactivating agent, quenching the resulting chemical reaction and recovering a product having controlled fiber modification.

14 Claims, No Drawings

METHOD FOR MODIFYING FIBERS OF A FABRIC AND THE PRODUCTS SO PRODUCED

The present invention relates to a method for modifying the fibers of a fabric. In one aspect, it relates to a method for modifying fibers of a fabric wherein the fiber modification is controlled. In still another aspect the invention relates to the products produced by the modification of fibers of a fabric.

Methods have heretofore been proposed for modifying fibers of fabrics, such as polyester fabrics, so as to improve certain properties of the fabrics or to alter their appearance. Numerous chemical and physical means have been employed to accomplish such fiber modification. For example, a large variety of chemicals, such as depolymerizing agents, have been incorporated into fabrics so that a depolymerization reaction could occur thus altering the fiber characteristics of the fabric. Additionally, methods have been proposed to heat dry fabrics to alter the fiber characteristics of such fabrics. However, when employing the methods proposed by the prior art, problems have been encountered if one attempts to efficiently and effectively confine the area of treatment of a fabric to a predetermined surface, or area, without modifying the fibers of the fabric completely throughout same. Thus, a need has long been recognized for an improved method which would allow one to effectively and efficiently modify certain fibers of a fabric without affecting other fibers and thereby produce a fabric having desired characteristics or appearance.

An object of the invention is to provide an improved process for modifying fibers of a fabric. Another object of the invention is to provide an improved fabric in which a preselected portion of the fibers of the fabric have been modified. Yet another object of the invention is to provide an improved process for modifying fibers of a fabric wherein the fiber modification is conducted on a specific area and/or to a desired depth of penetration into the fabric while maintaining other fibers in the fabric in their unmodified condition. These and other objects, advantages and features of the invention will be apparent to those skilled in the art from a reading of this disclosure.

Broadly, the present invention relates to improved products and to methods for producing same wherein selected fibers on or near one surface of a fabric are modified without modification of other fibers within the fabric. The controlled modification of fibers of the fabric is achieved by first applying an effective amount of a heat activated fiber modifying agent to the fabric to insure that the fibers in or near at least one surface of the fabric are sufficiently wet or covered with the heat activated fiber modifying agent. An effective amount of a deactivating agent is applied to a surface of the textile fabric, such surface being opposite to a surface containing fibers wet with the heat activated fiber modifying agent. Thereafter, heat is applied to the surface of the fabric, hereinafter referred to as face of the fabric, which contains the fibers wet with the heat activated fiber modifying agent for a period of time effective to initiate a chemical reaction between the fibers of the fabric wet or coated with the fiber modifying agent. To assist in the control of the fiber modification a temperature differential is maintained across the fabric, e.g., between the face of the fabric containing the fibers coated or wet with the heat activated modifying agent and the surface of the fabric containing the fibers wet or coated with the deactivating agent.

Once the desired fiber modification has occurred, the fabric and thus the chemical reaction is quenched to prevent further fiber modification and to remove any residual fiber modifying agent and/or deactivating agent from the fabric. Thereafter, the resulting product is recovered. It is to be understood, that if desirable, other normal processing steps in the manufacturing process of fabrics can be employed without altering the method of modification of select fibers of a fabric. For example, after the fiber modification has occurred due to the chemical reaction between the fibers being modified and the heat activated fiber modifying agent, and the reaction has been quenched, the resulting fabric can be napped, dyed, and the like. Such fabric processing procedures are well known to those skilled in the art.

The particular method of application of the heat activated fiber modifying agent to the fibers of the fabric which are to be modified in accordance with the present invention and the application of the deactivating agent to fibers of the fabric opposite the face of the fabric where such fiber modification is to occur can vary, and such will be discussed in detail hereinafter. However, it is important to note that in practicing the present invention wherein controlled fiber modification of a fabric is achieved such is accomplished by providing at least the face of the fabric with the heat activated fiber modifying agent and the opposite surface of the fabric with the deactivating agent.

Any suitable fabric formed of fibers which are capable of reacting with a heat activated fiber modifying agent, upon application of heat, to provide a chemical and/or physical change in the fibers can be employed in the practice of the present invention. Thus, suitable fabrics can be formed of natural and/or synthetic fibers. Examples of fabrics which can be employed are those containing fibers of polyesters, nylon, acetate, Kevlar, wool, cotton, linen, silk, acrylic and mixtures of such fibers. Especially desirable results can be obtained when the fabric is one formed of polyester fibers and blends of polyester and cotton fibers.

Once the fabric substrate has been selected and it is determined that it is desirable to modify the fibers of the face of the fabric, such can readily be accomplished employing the method of the present invention. As previously stated, the fibers on and near the surface of the face of the fabric are wetted or coated with a heat activated fiber modifying agent, whereas the fibers of the fabric on the back of the fabric, e.g., the side portion of the fabric opposite the face, and, when desirable, the fibers of the fabric intermediate the face and back, are wetted or coated with a deactivating agent so that, upon subsequent application of heat to the face of the fabric and thus to the fibers wet or coated with the heat activated fiber modifying agent, a reaction occurs between such fiber modifying agent and the fibers wet or coated with such agent to alter the physical and/or chemical properties of such fibers without modifying the remaining fibers of the fabric.

Many methods can be employed to apply the heat activated fiber modifying agent and the deactivating agent to the fabric substrate. For example, the fabric substrate can be padded with a liquid admixture containing at least one heat activated fiber modifying agent and thereafter nipped to remove excess liquid from the wetted fabric. In such instance sufficient heat activated fiber modifying agent is employed in the liquid admixture to substantially wet and coat all of the fibers of the fabric with the fiber modifying agent. The amount of heat activated fiber modifying agent present in the liquid admixture can vary widely but will generally be present in an amount of from about 0.1 to 25 weight percent. Especialy desirable results can be obtained when the heat activated fiber modifying agent or agents is present in the liquid admixture in an amount of from about 0.5 to about 15 weight percent. Further, the liquid admixture can contain a single heat activated fiber modifying agent or a combination of such agents.

A deactivating agent is then applied to the back of the padded fabric in an amount sufficient to deactivate the heat activated fiber modifying agent or agents wetting or covering the fibers on the back of such fabric and to a desired depth within such fabric so as to prevent a reaction between the heat activated fiber modifying agent and the fibers in area where fiber modification is undesired. Any suitable means can be employed to apply the deactivating agent to the wet or padded fabric, such as spraying, printing, knife-coating, kiss-coating, dusting and the like.

The amount of deactivating agent employed will vary widely, such being dependent upon the amount of fibers or portions of the fabric to be protected from the action of the heat activated fiber modifying agent. Generally, the amount of deactivating agent present in the liquid admixture or paste is from about 0.1 to about 25 weight percent, preferably from about 0.5 to about 15 weight percent. Further, the liquid admixture or paste can contain a single deactivating agent or a combination of such agents.

Another suitable method for applying the heat activated fiber modifying agent to the fabric is to apply such agent to only the face of the fabric. The deactivating agent can be applied to the back of the fabric either simultaneously or sequentially to the application of the heat activated fiber modifying agent. Further, if desired, the heat activated fiber modifying agent can be applied to the face of the fabric as a pattern or design. The heat activated fiber modifying agent can be applied to the face of the fabric in any suitable form such as a solid, paste, liquid admixture or the like provided sufficient heat activated fiber modifying agent is present to sufficiently wet or coat the fibers of the fabric which are to be modified.

The deactivating agent can be applied to the back of the fabric as a solid, paste or liquid admixture as previously described. However, care should be exercised to insure that sufficient deactivating agent is employed to deactivate any heat activated fiber modifying agent which may be present in an area of the fabric where no fiber modification is desired without deactivating the heat activated fiber modifying agent in those areas where fiber modification is desired.

Many other methods of application of the heat activated fiber modifying agent and the deactivating agent can readily be envisioned by those skilled in the art. The particular methods of application set forth are to be considered merely illustrative, the only essential feature being the application of the heat activated fiber modifying agent to at least those fibers which are to be modified in and/or near the face of the fabric and the application of the deactivating agent to the back of the fabric to deactivate the heat activated modifying agent in those areas or portions of the fabric only where no fiber modification is desired.

The term "heat activated fiber modifying agent" as used herein is to be understood to mean those chemicals which, upon application of heat, readily and quickly react with the fibers of a fabric and thus alter the physical and/or chemical properties of the fibers. Typical of the reactions produced between such heat activated fiber modifying agents and the fibers are depolymerization, functional group substitution, grafting or polymerization, chemical crosslinking and the like. Any suitable heat activated fiber modifying agent can be employed to carry out the method of the present invention. Further, it should be understood that many of "the heat activated fiber modifying agents" which can be employed in the practice of the present invention may have a propensity to slowly react with the fibers of the material being treated at ambient temperatures. However, such compounds when heated, react rapidly with the fibers to produce the desired controlled fiber modification in accordance with the present invention.

As previously stated, any heat activated fiber modifying agent which is capable of reacting with the fibers of a fabric at elevated temperatures can be employed. Generally, such compounds are chemical compounds known in the art as nucleophiles, electrophiles, free radical precursors, free radicals, mixtures of such compounds and the like. Nucleophiles are to be understood to be nucleophilic compounds in which the nucleophilic atom is $H^-$, O, N, S, P or a halogen. Such nucleophilic compounds are generally represented by the formula RAM wherein R is H, an alkyl, aryl, alicyclic, substituted alkyl, substituted aryl and substituted alicyclic moiety, A is a nucleophilic atom as previously defined, and M is a counter cation selected from the group consisting of H, Group IA, IIA, and IIIA of the Periodic Table, transition metals, quarternary ammonium or quaternary phosphonium compounds. The alkyl moiety of R can be a saturated, unsaturated, branched or straight chain alkyl moiety and can be mono - or poly - substituted at any position by O, N, S, P, a halogen, or an organic moiety such as aryl, substituted aryl, alicyclic, substituted alicyclic, heterocyclic and substituted heterocyclic moieties.

Electrophiles are electron deficient species, such as Lewis acids, alkylating agents and the like which are capable of reacting with the fibers of the fabric being treated. The Lewis acids which can be employed in the practice of the invention can be generated from the following precursors:

$HNO_3—H_2SO_4$ $HNO_2$ $R—\overset{\overset{\displaystyle O}{\|}}{C}—X + AlCl_3$ $(R—\overset{\overset{\displaystyle O}{\|}}{C})_2O$ $R—X + AlCl_3$ $CH_3—O—\overset{\overset{\displaystyle O}{\|}}{\underset{\underset{\displaystyle O}{\|}}{S}}—O—CH_3$ -continued

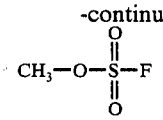

and the like wherein R is H, an alkyl, aryl, alicyclic, substituted alkyl, substituted aryl, and substituted alicyclic moiety and X is a halogen, such as Cl, Br, F and I.

Likewise, any suitable free radical precursor or free radical can be employed as the heat activated fiber modifying agent in the method of the invention provided such free radical precursor or free radical is capable of reacting with the fibers of the fabric under the specified conditions. Typical of such free radical precursors and free radicals are azo-bis-(isobutyronitrile), di-tert-butylperoxide, benzolyl peroxide, metals of Group IA, IIA and IIIA of the Periodic Table and odd electron species such as napthalene radical anion, galvanoxyl, diphenylpicrylhydrazil and Fremi's salt.

The term "deactivating agent" as used herein is to be understood to mean those chemicals which prevent the reaction of the heat activated fiber modifying agent with the fibers of a fabric, even upon application of heat, and thus prevent alteration or modification, either physically or chemically of the fibers of such fabric. The particular deactivating agent employed will thus be dependent upon the heat activated fiber modifying agent employed. For example, when a nucleophile is employed as the heat activated fiber modifying agent, the deactivating agent can be an organic or inorganic acid. Typical of such organic acids are acetic acid, formic acid, propionic acid, and the like. Typical of inorganic acids which can be employed as the deactivating agent are HCl, $H_2S0_4$, $H_3PO_4$ and the like.

When an electrophile is employed as the heat activated fiber modifying agent the deactivating agent can be water, $NH_3$, mono-, di- or tri-substituted amines, such as aniline, diisopropyl amine, triethyl amine, ethylene diamine, and the like, aliphatic alcohols, such as methanol, ethanol, isopropanol and the like, mixtures of such agents and the like.

The deactivating agent for free radical precursors or free radical heat activated fiber modifying agents can be any compound which is preferential for reaction with the heat activated fiber modifying agent over the reaction between the fiber of the fabric and the heat activated agent. Typical of deactivating agents which fulfill such requirements are butylhydroxyanisol, butylhydroxytoluene, tri-tert-butylphenol, hydroquinone and metal salts, such as $FeCl_3$ and the like.

As previously stated, one essential aspect of the subject invention is the application of the heat activated fiber modifying agent to fibers of the fabric which are to be modified and the application of a deactivating agent to the remaining fibers of the fabric. Thus, it is often desirable to formulate the liquid admixtures or pastes containing the heat activated fiber modifying agent and the deactivating agent having sufficient viscosities to prevent uncontrolled migration or wicking of such agents within and/or throughout the fabric. Generally, such can be accomplished by the incorporation of an effective amount of a thickening agent into the liquid carrier of the liquid admixture or paste to provide an admixture or paste having a viscosity of from about 500 cps to about one million cps (viscosity as determined by a Brookfield RVF with a No. 6 spindle at 4 rpm, when the viscosity is more than 3,000 cps and by a Brookfield RVF with a No. 2 spindle at 10 rpm when the viscosity is less than about 3,000 cps). Especially desirable results can be obtained when the heat activated fiber modifying agent is applied to the fibers of the fabric as a liquid admixture having a viscosity of from about 500 cps to about 10,000 cps and the deactivating agent is applied to the fibers of a fabric as a liquid admixture having a viscosity of from about 500 cps to about 100,000 cps.

Any suitable liquid which is substantially inert to the heat activated fiber modifying agent and the fibers of the fabric can be employed as the carrier liquid for the liquid admixture or paste containing the heat activated fiber modifying agent. Likewise, any liquid which is substantially inert to the deactivating agent and the fibers of the fabric can be employed as the carrier liquid for the liquid admixture or paste of the deactivating agent. Further, the carrier liquids for the heat activated fiber modifying agent and the deactivating agent should be substantially inert to each other. Thus, the particular carrier liquid employed for either the heat activated fiber modifying agent or the deactivating agent will be dependent to a large extent upon the particular heat activated fiber modifying agent, the particular deactivating agent, the chemical make-up of the fibers of the fabric chosen by the processor or manufacturer. Generally, the carrier liquid is an organic solvent or water. Water is, of course, normally preferred.

Typical of organic solvents which can be employed as the liquid carrier for the heat activated fiber modifying agent and deactivating agent are non-polar solvents, e.g., the chlorinated hydrocarbon solvents, such as trichloroethylene, carbon tetrachloride, and the like, aromatic solvents such as benzene, toluene and the like, alcohols such as ethanol, isopropanol, hexanol and the like, ethers such as diethyl ether, dioxane and the like, hydrocarbon solvents such as hexanes, octanes and the like, and polar organic solvents such as dimethyl sulfoxide, dimethyl formamide and the like.

When it is determined desirable to increase the viscosity of the liquid admixture containing the heat activated fiber modifying agent and the deactivating agent such can readily be accomplished by the use of an effective amount of a thickening agent which is compatible with the liquid carrier of the admixture and is substantially inert to the constituent of the liquid admixture. Such thickening agents are well known in the art. However, for illustrative purposes, typical thickening agents when water is the carrier liquid are the cellulose derived thickening agents, gums, such as guar gum, polysaccarides, polyacrylates, silicates and the like. Thickening agents which can be employed when an organic solvent is used as the carrier liquid are the commerically available thickening agents sold under the trademarks Carbopol, Cabosil and the like.

Once the appropriate heat activated fiber modifying agent, deactivating agent and fabric have been selected and such agents have been applied to the fabric so that the fibers on and/or near the face of the fabric have been wetted or coated with the heat activated fiber modifying agent and the back portion of the fabric and thus the remaining fibers have been wetted or coated with the deactivating agent, the face of the fabric is heated to a temperature sufficient to initiate a reaction between the heat activated fiber modifying agent and the fibers of the fabric wetted or coated with same. The temperature to which the face of the fabric is heated can vary, provided same is heated to a temperature necessary to effectively and efficiently activate the heat activated fiber modifying agent. However, care must be exercised to insure that the heating temperature does not reach the melting temperature of the fibers of the fabric. Generally, desirable results can be obtained when the face of the fabric is heated to a temperature of from about 150° F. to about 425° F.

The time required for the heating of the fibers of the fabric being modified can vary widely provided such period of time is sufficient to allow the desired reaction and fiber modification to occur. The required heating period will depend to a large extent upon the amount of fiber modification desired, as well as the response of the treated fibers of the fabric to the heatsource. However, generally the heating period is within a time period of from about 0.1 second to about 1 minute, preferably from about 0.5 second to about 20 seconds.

Any suitable heating means can be employed as the heat source to initiate the reaction between the fibers of the fabric and the heat activated fiber modifying agent. For example, contact heating means, convection heating means, radiant heating means, and open flame can be employed to heat the heat activated fiber modifying agent and the fibers of the fabric to a desired temperature to allow the fiber modification to occur. Especially desirable results have been otained when a contact heating means such as a heated can is employed as the heat source because the use of such heated can provides efficient transfer of heat to the fabric and thus the fibers of same coated with the heat activated fiber modifying agent.

Simultaneously, with the heating of the fibers wet or coated with the heat activated fiber modifying agent, it is desirable to maintain a temperature differential between the heated face of the fabric and the back of the fabric to assist in the control and degree of fiber modification within the fabric. Generally, the back of the fabric will be maintained at a temperature of from about 70° F. to about 280° F. so as to provide a temperature on the back of the fabric of at least about 50° F., preferably at least about 100° F., cooler than the temperature of the fibers on the face of the fabric.

When it is determined that it is desirable to cool the back of the fabric to provide the desired temperature differential between the face of the fabric and the back of the fabric, various cooling means can be employed to cool the back of the fabric. For example, cool air can be blown across the back of the fabric or cooling rollers can be employed to cool the back of the fabric to insure that the required temperature differential is maintained between the face of the fabric wherein the desired fiber modification is to occur and the back of the fabric where no fiber modification is desired.

After the desired fiber modification has occurred due to the combination of the heat activated fiber modifying agent, the deactivating agent, the heat, and the maintaining of the temperature differential across the fabric, the resulting modified fabric is quenched to prevent further fiber modification by the heat activated fiber modifying agent. Any suitable quenching process can be employed. However, especially desirable results can be obtained when the modified fabric is quenched with water or an aqueous admixture containing at least one deactivating agent to remove and/or inactivate the remaining heat activated fiber modifying agent. After quenching, the modified fabric can be washed, dried or subjected to other textile or fabric processing conditions such as steaming, dyeing, napping, sanding and the like.

It should be noted that while any of the before-mentioned heating means can be used as the heat source to initiate the reaction between fibers of the fabric wet with the heat activated fiber modifying agent, care should be exercised to insure uniform heat application to the side portion of the fabric wherein fiber modification of the fabric is to occur. Thus, it may be desireable to place the fabric under tension to insure a substantially smooth uniform surface of the fabric during application of heat.

In order to illustrate further the details of the method of this invention, the following specific examples are given. These examples are presented primarily for the purpose of illustration and any enumeration or details contained therein are not to be interpreted as a limitation on the invention except as indicated in the appended claims. All weights referred to in these examples are parts by weight unless otherwise indicated.

EXAMPLE I

A series of experiments were conducted to determine the effectiveness of controlled fiber modification of a fabric when employing the combination of a heat activated fiber modifying agent and a deactivating in conjunction with the concept of maintaining a temperature differential between the heat surface of the fabric wherein fibers are wet with the heat activated fiber modifying agent and the opposite side of the fabric wherein the fibers are wet or covered with the deactivating agent. In each experiment the fabric sample, a textured polyester double knit fabric unless otherwise indicated, was padded with an aqueous admixture containing 5 weight percent sodium hydroxide and 2 weight percent of a quarternary ammonium salt (Arquad C-50 manufactured by Armak Chemicals Division). Excess liquid was removed from the padded fabric sample by nipping same at 60 psi.

A second aqueous admixture containing 5 weight percent acetic acid and an effective amount of a cellulosic thickening agent (Cellosize QP 4400 manufactured by Union Carbide Corporation) to provide a viscosity of about 300,000 cps was then applied to the back of the fabric using a coating knife over plate. The blade of the coating knife was set for 0 and 5 mils clearance above the fabric. Even at the 0 mil clearance sufficient of the thickened second aqueous admixture was applied to the back of the fabric to sufficiently cover all of the fibers of the back portion of the fabric and thus deactivate the heat activated fiber modifying agent present on such fibers.

The samples of the thus treated fabric were then placed on a hot plate which had been heated to a temperature of 390° F. for various periods of time. In each instance the face of the fabric, e.g., that portion containing fibers wetted or coated with the first aqueous admixture (the heat activated fiber modifying agents) was placed on the hot plate so that such fibers were brought into contact with the heated surface of the hot plate. The temperature was measured using a thermometer at a distance of ¼ inch above the back of the fabric, e.g., that portion of the fabric removed from the surface of the hot plate, and found to be about 127° F., such illustrating a substantial temperature differential between the heat face and the back of the fabric. The temperature of the air ¼ inch above the hot plate without the fabric being on the hot plate was about 176° F. Table I summarizes the results of such experiments.

TABLE I

| Contact Time Sec. | Blade (mils) | % Loss Yarn Strength Face | % Loss Yarn Strength Back | % Loss Mullen[1] Burst Strength |
|---|---|---|---|---|
| 20[2] | — | 59 | 15 | 35 |
| 40[2] | — | rotted | 28 | 57 |
| 20 | 0 | 47 | 9 | 10 |
| 20 | 0 | 57 | 9 | 10 |
| 20 | 5 | 52 | 10 | 12 |
| 40 | 0 | 69 | 11 | 44 |
| 40 | 0 | 88 | 8 | 45 |
| 40 | 5 | 76 | 20 | 45 |
| 60 | 0 | 91 | 7 | 52 |
| 60 | 5 | 94 | 15 | 55 |
| 30[3] | 0 | 60 | 18 | 24 |
| 40[3] | 0 | 63 | 19 | 30 |

[1]Mullen burst strength measurements made by holding fabric over a rubber diaphragm and measuring the pressure at burst in psi.
[2]Padded with first aqueous admixture containing heat activated fiber modifying agent but no deactivating agent coated on back.
[3]Non-textured polyester fabric.

EXAMPLE II

A second series of experiments were conducted using the same procedure of Example I with the exception that the concentration of acetic acid (deactivating agent) employed in the second aqueous admixture was varied and two different coating knifes were employed to apply the second aqueous admixture to the fabric. In the table below under the heading "Knife," G represents a coating applied with a Gardner Knife whereas C represents a coating applied with a Coater Knife. The results of these experiments are tabulated below:

TABLE II

| Contact Time (Sec.) | % Acetic Acid | Knife | Knife Setting (Mils.) | % Loss Yarn Strength Face | % Loss Yarn Strength Back | % Loss Mullen[1] Burst Strength |
|---|---|---|---|---|---|---|
| 40 | 0 | — | — | Rotted | 27 | 59 |
| 40 | 0 | — | — | Rotted | 28 | 57 |
| 40 | 2.5 | G | 0 | 81 | 18 | 52 |
| 40 | 5.0 | G | 0 | 92 | 12 | 61 |
| 40 | 10.0 | G | 0 | 79 | 8 | 41 |
| 40 | 2.5 | C | 0 | 83 | 10 | 56 |
| 40 | 2.5 | C | 5 | 85 | 16 | 56 |
| 40 | 5.0 | C | 0 | Rotted | 16 | 53 |
| 40 | 5.0 | C | 5 | 84 | 16 | 53 |
| 40 | 10.0 | C | 0 | 79 | 15 | 36 |
| 40 | 10.0 | C | 5 | 56 | 11 | 25 |
| 40 | 10.0 | C | 0 | 69 | 11 | 24 |
| 40 | 10 | C | 0[2] | 69 | 13 | 32 |

[1]Mullen burst strength measurements made by holding fabric over a rubber diaphragm and measuring the pressure at burst in psi.
[2]80 psi nip.

The above data of the Examples clearly indicate the use of the deactivating agent on the back surface of the fabric enhances the retarding of fiber modification on such surface.

That which is claimed is:

1. A method for modifying fibers in the stratum of fibers at one surface of a fabric comprising:

(a) applying an effective amount of a heat activated fiber modifying agent to a fabric to substantially cover the fibers in the stratum of fibers of one or both surfaces of the fabric;

(b) applying an effective amount of a deactivating agent to a second surface of the fabric to substantially cover the fibers of said fabric which are to remain substantially unmodified within said fabric, said second surface being opposite the surface containing the stratum of fibers of said fabric to be modified with said heat activated fiber modifying agent;

(c) heating the surface of said fabric containing the stratum of fibers to be modified and covered with said heat activated fiber modifying agent at a temperature of from about 150° F. to about 425° F. for a period of time effective to allow modification of the fibers in the stratum of fibers to be modified by a chemical reaction between the fibers coated with the heat activated fiber modifying agent in such stratum of fibers and such agent;

(d) simultaneously maintaining a temperature differential of at least about 50° F. between the heated portion of the fabric containing the stratum of fibers to be modified and covered with said heat activated fiber modifying agent and second surface of said fabric so that the depth of penetration of the chemical reaction and fiber modification is controlled to substantially the stratum of fibers to be modified;

(e) quenching the chemical reaction; and (f) recovering a resulting product.

2. The method of claim 1 wherein the said opposite surface is maintained at a temperture of at least about 100° F. lower than said surface containing the stratum of fibers of said fabric to be modified.

3. The method of claim 2 wherein said time period effective to initiate the chemical reaction between the heat activated fiber modifying agent and the fibers in the stratum of the fabric to be modified is from about 0.1 second to about 1 minute.

4. The method of claim 2 wherein said heat activated fiber modifying agent is applied to said fabric as a liquid admixture containing from about 0.1 to about 25 percent of said heat activated fiber modifying agent and said liquid admixture is initially padded onto said fabric to sufficiently cover all of the fibers of said fabric.

5. The method of claim 4 wherein said liquid admixture further contains an effective amount of a thickening agent to provide an admixture having a viscosity of from about 500 cps to about one million cps.

6. The method of claim 5 wherein the liquid carrier of said liquid admixture is selected from the group consisting of organic solvents and water.

7. The method of claim 6 wherein said liquid admixture has a viscosity of from about 500 cps to about 10,000 cps.

8. The method of claim 5 wherein said liquid admixture is an aqueous admixture.

9. The method of claim 4 wherein said heat activated fiber modifying agent is present in an amount of from about 0.5 to about 15 percent.

10. The method of claim 1 wherein said deactivating agent is applied as a liquid admixture containing from about 0.1 to about 25 weight percent of said deactivating agent.

11. The method of claim 10 wherein said liquid admixture further contains an effective amount of a thickening agent to provide an admixture having a viscosity of from about 500 cps to about one million cps.

12. The method of claim 11 wherein the liquid carrier of said liquid admixture is selected from the group consisting of organic solvents and water.

13. The method of claim 12 wherein said liquid carrier is water.

14. The method of claim 13 wherein said deactivating agent is present in said aqueous admixture in an amount of from about 0.5 to 15 weight percent.

* * * * *